US006125488A

United States Patent [19]

Vogland et al.

[11] Patent Number: 6,125,488

[45] Date of Patent: Oct. 3, 2000

[54] CORNER GUARD FOR A MATTRESS FOUNDATION

[75] Inventors: James H. Vogland; William B. Hutton, both of Saint Helens, Oreg.

[73] Assignee: Hutton International, Inc., St. Helens, Oreg.

[21] Appl. No.: 09/344,009

[22] Filed: Jun. 25, 1999

Related U.S. Application Data

[60] Provisional application No. 60/090,915, Jun. 26, 1998, and provisional application No. 60/119,484, Feb. 10, 1999.

[51] Int. Cl.[7] ..... A47C 23/00

[52] U.S. Cl. ..... 5/739; 5/663; 248/345.1

[58] Field of Search ..... 248/345.1; 52/287.1, 52/288.1; 5/663, 254, 739, 466, 260, 246, 474; D6/606

[56] References Cited

U.S. PATENT DOCUMENTS

| | | | |
|---|---|---|---|
| D. 384,537 | 10/1997 | Quintile . | |
| 1,088,959 | 3/1914 | Benton . | |
| 4,089,497 | 5/1978 | Miller et al. | 5/663 X |
| 4,817,902 | 4/1989 | Mason . | |
| 5,077,847 | 1/1992 | Boyd . | |
| 5,411,621 | 5/1995 | Johenning . | |
| 5,508,078 | 4/1996 | Stalnaker | 428/71 |
| 5,628,080 | 5/1997 | Quintile . | |
| 5,657,955 | 8/1997 | Adams . | |
| 5,771,506 | 6/1998 | Joiner | 5/663 X |
| 5,864,906 | 2/1999 | Pacelli . | |
| 5,878,455 | 3/1999 | Patterson . | |
| 5,884,385 | 3/1999 | Quintile . | |

FOREIGN PATENT DOCUMENTS 909976 11/1962 United Kingdom .

*Primary Examiner*—Terry Lee Melius
*Assistant Examiner*—Fredrick Conley
*Attorney, Agent, or Firm*—Kolisch Hartwell Dickinson McCormack & Heuser

[57] ABSTRACT

A corner guard configured to attach to and protect the corner of a mattress foundation, as well as to receive selected ornamentation. The corner guard includes an impact-resistant core and a cover that overlies at least at portion of the core. In one embodiment of the invention, the cover is constructed of fabric and may be ornamented with patterns or indicia by a variety of techniques. The cover ensures that the ornamentation will not be damaged even if the corner guard must be bent to match the shape of the mattress foundation. Optionally, a foam layer may be positioned between the core and the cover to impart a quilted texture and appearance to the corner guard, and to provide additional padding for the mattress foundation.

12 Claims, 2 Drawing Sheets

CORNER GUARD FOR A MATTRESS FOUNDATION

CROSS-REFERENCE TO RELATED APPLICATIONS

This application claims priority from U.S. Provisional patent application Ser. No. 60/090,915 entided "MATTRESS BOX SPRING CORNER GUARD MADE OF BRASS OR MADE OF PLASTIC AND UPHOLSTERED" filed on Jun. 26, 1998, and from U.S. Provisional patent application Ser. No. 60/119,484 entitled "UPHOLSTERED AND EMBROIDERED BOX SPRING CORNER GUARD" filed on Feb. 10, 1999.

FIELD OF THE INVENTION

The present invention relates generally to mattress foundation assemblies, and more particularly to a mattress foundation corner guard having a cover which is configured to receive ornamentation.

BACKGROUND

Bedding manufacturers often install corner guards on the lower, exterior side corners of their fabric-covered mattress foundations such as box springs, etc. These corner guards protect the fabric at the corners of the mattress foundation from being snagged or worn against the bed frame or against other objects when the mattress foundation is being moved. Preferably, corner guards should be resistant to impacts and sized to fit between the mattress foundation and the bed frame.

Prior art corner guards have been molded from a plastic such as polyethylene or polypropylene which can easily be bent around the corner of the mattress foundation. These corner guards usually include one or more tabs which can be positioned underneath the mattress foundation and attached to the bottom of the mattress foundation by tacks, nails, staples, etc. Examples of these corner guards are described in U.S. Pat. Nos. 5,884,385 and 5,628,080 to Quintile, U.S. Pat. No. 5,878,455 to Patterson, U.S. Pat. No. 5,864,906 to Pacelli, U.S. Pat. No. 5,657,955 to Adams, and U.S. Pat. No. 1,088,959 to Benton, the disclosures of which are herein incorporated by reference. Although conventional plastic corner guards are functional and inexpensive to manufacture, they detract from the appearance of the mattress foundation and mattress. Therefore, many manufacturers would prefer to ornament the corner guard with trademarks, brand-names, logos, decorations, and etc., to improve the appearance of the corner guards.

While there have been attempts to apply a paint or metal coating to conventional corner guards, the plastic surface of conventional corner guards are difficult to paint or coat because most paints and coatings have poor adhesion to plastic. As a result, when the corner guards are bent around the corner of the mattress foundation during installation, the paint or coating tends to crack and/or peel off. Alternatively, a metal plating may be applied to a pre-bent corner guard made from a stiff plastic such as acrylonitrile-butadiene-styrene (ABS). The metal plating is less likely to peel because the shape of the pre-bent corner guard is not changed during installation. However, the relative stiffness of the pre-bent corner guard leaves it susceptible to breakage under impact. Furthermore, the metal plating allows only limited ornamentation since it is difficult to provide metal platings in a variety of colors.

Therefore, it would be desirable to have an inexpensive, impact-resistant corner guard which may be ornamented as desired and which withstands bending without damage to the ornamentation.

SUMMARY OF THE INVENTION

The present invention provides a corner guard which is configured to attach to and protect the corner of a mattress foundation, as well as to receive selected ornamentation. The corner guard includes an impact-resistant core and a cover that overlies at least at portion of the core. In one embodiment of the invention, the cover is constructed of fabric and may be ornamented with patterns or indicia by a variety of techniques. The cover ensures that the ornamentation will not be damaged even if the corner guard must be bent to match the shape of the mattress foundation. Optionally, a foam layer may be positioned between the core and the cover to impart a quilted texture and appearance to the corner guard, and to provide additional padding for the mattress foundation.

DETAILED DESCRIPTION OF THE PREFERRED EMBODIMENT

Figure 1:
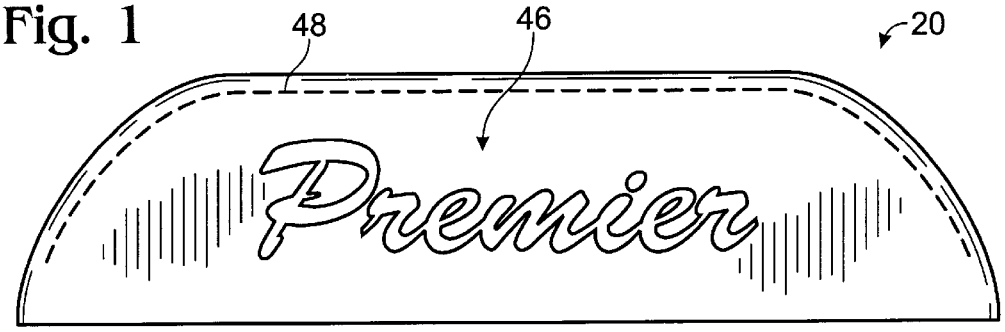
FIG. 1 is a front elevation of a mattress foundation corner guard in accordance with the present invention.
Figure 2:
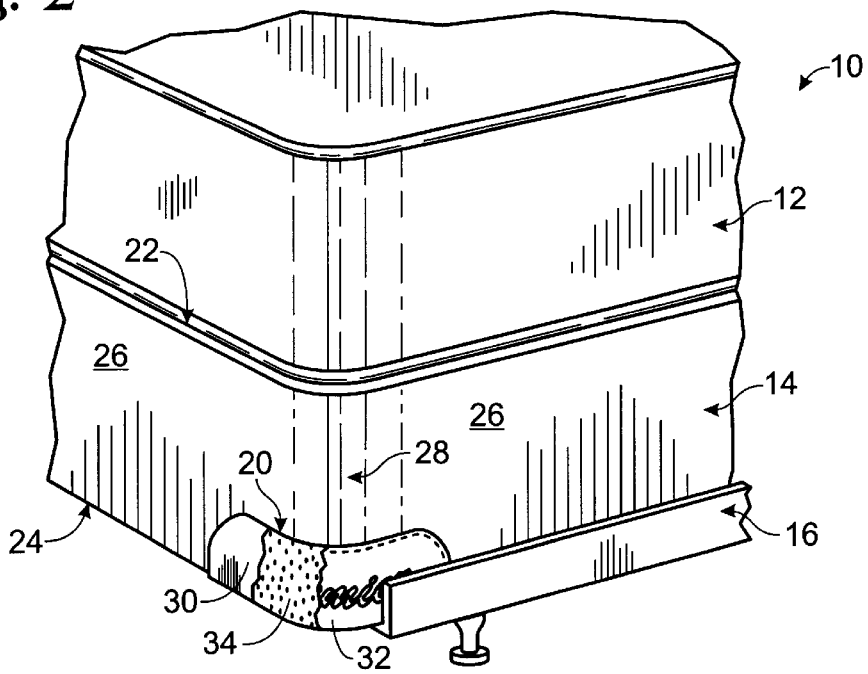
FIG. 2 is a fragmentary, isometric view of a bedding assembly showing the corner guard of FIG. 1 attached to a mattress foundation between the mattress foundation and a bed frame on a smaller scale than in FIG. 1. The corner guard is shown in cut-away view to illustrate its multi-layer structure.

Referring to FIGS. 1 and 2, a bedding assembly according to the present invention is shown generally at 10. Bedding assembly 10 typically includes a mattress 12, a mattress foundation 14, and a bedding support structure such as a bed frame 16. Mattress foundation 14 is configured and positioned to support mattress 12 above bed frame 16. Bedding assembly 10 also includes a novel corner guard 20, which is attached to mattress foundation 14 and fits between the mattress foundation and bed frame 16. As will discussed in more detail below, corner guard 20 is a multi-layer structure configured to provide protection for mattress foundation 14 as well as a durable ornamentation region which manufacturers can use to apply trademarks, logos, designs, etc.

Although corner guard 20 frequently is used to protect the corners of a mattress foundation such as a box spring, etc., those of skill in the art will appreciate that corner guard 20 is also well suited for attachment to a mattress or similar component of bedding. Therefore, while the invention is described below in the context of one particular bedding configuration in which only the mattress foundation requires the protection of a corner guard, it will be understood that the description includes other configurations in which corner guard 20 is attached to any component of bedding.

Mattress 12 typically is a fabric or plastic covered structure having an internal construction configured to provide a desired level of comfort and support to a person resting on the mattress. In accordance with the present invention, mattress 12 may be any of a variety mattress types such as an air mattress, spring mattress, foam mattress, etc., or may be some combination thereof. Thus, the present invention is not limited to a particular type of mattress.

Similarly, the invention is not limited to a particular type of mattress foundation as there are many types of mattress foundations well known in the art. The exemplary mattress foundation depicted in FIG. 2 is essentially a fabric covered base for mattress 12. Mattress foundation 14 includes upper support surface 22 which is typically sized to match mattress 12, and bottom surface 24 sized to fit within bed frame 16. In addition, mattress foundation 14 includes a plurality of side surfaces 26 which extend between upper surface 22 and bottom surface 24. At least two of the side surfaces intersect to form exterior side corner 28. While mattress foundation 14 is described as being sized to match mattress 12, it will be appreciated that the mattress foundation may be a different size than the mattress. As one example, king size beds usually have one mattress and two mattress foundations, each being one-half the size of the mattress. The pair of mattress foundations are positioned side-by-side on the bed frame.

Mattresses and mattress foundations are often sold as matched sets, in which case the fabrics which cover mattress 12 and mattress foundation 14 are typically matching. The fabrics may be a single color or may be patterned to form one or more designs. Alternatively, mattress 12 may match mattress foundation 14 where the respective fabrics have different, yet complimentary colors and/or designs.

As shown in FIG. 2, corner guard 20 is sized to extend from adjacent side surfaces 26 to cover at least a portion of corner 28. Corner guard 20 is positioned between mattress foundation 14 and bed frame 16 to protect a lower portion of corner 28 adjacent bottom surface 24. Corner guard 20 protects the fabric covering corner 28 from wear and tear which might otherwise occur when the mattress foundation is being moved as well as during normal use. While mattress 12 and mattress foundation 14 may be of any desired shape, they are usually rectangular and, therefore, have four exterior corners 24. A corner guard according to the present invention is typically positioned at each corner to provide complete protection. Alternatively, corner guard 20 may be sized and positioned to protect other areas of mattress foundation 14 and/or mattress 12.

Figure 3:
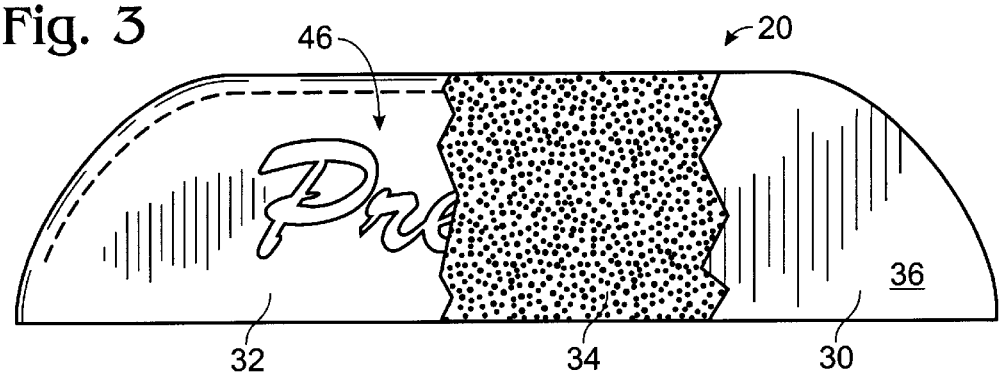
FIG. 3 is a cut-away front elevation of one embodiment of the invention in which a layer of foam is disposed between the cover and the core.
Figure 4:
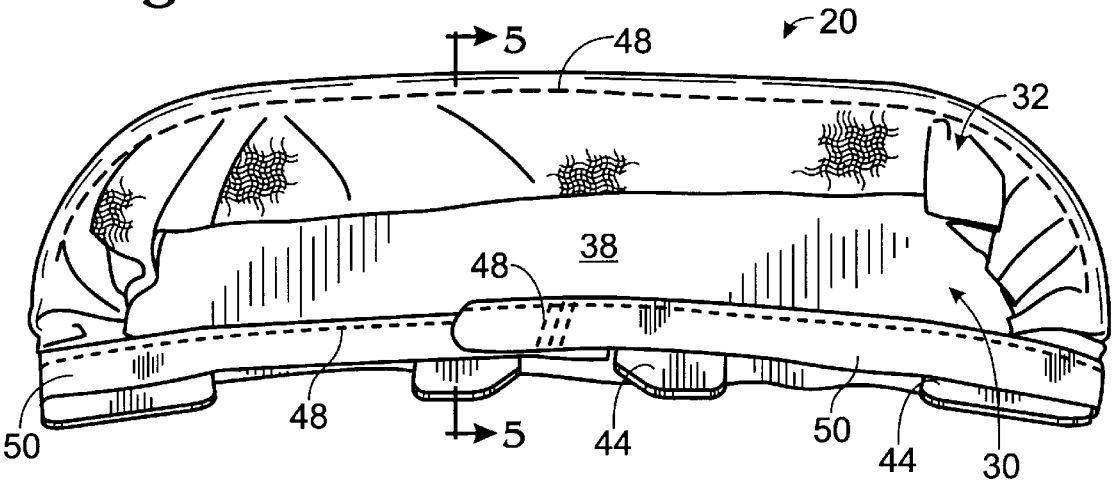
FIG. 4 is a rear isometric view of the corner guard of FIG. 3 showing the tabs and the attachment of the cover to the core with binding tape.
Figure 5:
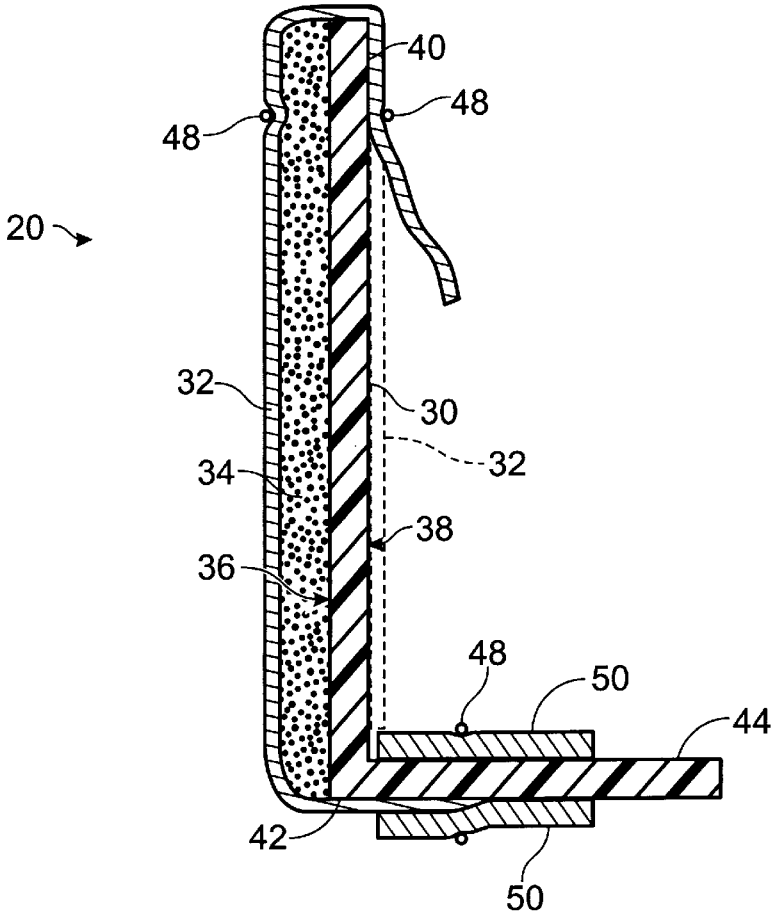
FIG. 5 is a cross-sectional view taken generally along the line 5—5 in FIG. 4, showing a three-layer construction and the attachment of the cover to the core with stitching. An alternative embodiment of the corner guard in which the cover is formed as a pocket to enclose substantially all of the core is indicated by a dashed line.

Referring now to FIGS. 3–5, a particular embodiment of corner guard 20 is depicted and includes an impact-resistant core 30, a cover 32, and a compressible lining 34 disposed between core 30 and cover 32. In an alternative embodiment of the invention, compressible lining 34 is omitted.

In one embodiment of the invention, core 30 is at least partially bendable so that it can be shaped to fit around corner 28 during installation. In this embodiment, core 30 may be formed either as a flat piece, or pre-bent to generally match the shape of corner 28. As will be appreciated by those of skill in the art, there are a variety of suitable materials for constructing an impact-resistant, bendable core. While polyethylene and polypropylene are particularly well-suited and commonly used for corner guards, other bendable plastics may also be used. Alternatively, other materials such as relatively thin, bendable metal may be used either alone or in combination with a plastic. In any event, although core 30 is bendable, it nevertheless resists impacts and penetration by sharp objects to protect the underlying mattress foundation.

In an alternative embodiment of the invention, core 30 may be formed of a relatively stiff material in a pre-bent configuration to fit around corner 28. Suitable materials include metal and stiff plastics such as ABS, etc. In this embodiment, it will be appreciated that core 30 is preferably formed with a shape to substantially match the shape of corner 28.

Core 30 includes a front surface 36, a back surface 38, an upper edge 40 and a lower edge 42. When attached to the mattress foundation, back surface 38 is adjacent the mattress foundation while front surface 36 faces outward. Lower edge 42 is typically positioned adjacent the intersection of a side surface 26 with bottom surface 24 of the mattress foundation. Upper edge 40 preferably, though not necessarily, extends up corner 28 to a point above bed frame 16. While core 30 is depicted in FIGS. 1–4 as a generally thin, elongate rectangle with rounded corners adjacent the upper edge, it will be appreciated that the core can be formed in a wide variety of shapes as desired.

As shown in FIGS. 4 and 5, corner guard 20 includes a plurality of tabs 44 extending generally perpendicularly from lower edge 42 of core 30. When corner guard 20 is positioned around corner 28 and adjacent lower edge 42, tabs 44 extend along the bottom surface of the mattress foundation and provide a means of attaching the corner guard to the mattress foundation. Typically, corner guard 20 is attached to mattress foundation 14 by stapling, tacking, or nailing tabs 44 to bottom surface 24. Optionally, the tabs may include holes (not shown) through which tacks or nails may be passed. Although tabs 44 are described as extending generally perpendicularly from core 30, it will be appreciated that the tabs may alternatively be formed at some other angle or in the same plane as the core, and then bent as necessary to press against the bottom surface of the mattress foundation during installation. Furthermore, it will be appreciated that corner guard 20 may include any number of tabs or only a single tab. Alternatively, corner guard 20 may omit tabs altogether and attach to mattress foundation 14 using a different mechanism.

Turning attention particularly to FIGS. 3–5, cover 32 is attached to core 30 and extends across and overlies at least a portion of front surface 36. Preferably, cover 32 overlies substantially all of front surface 36 so that little, if any, of core 30 can be seen when the corner guard is attached to the mattress foundation. Cover 32 serves to conceal core 30 and thereby provide a more aesthetically pleasing corner guard. In the embodiment of the invention where the core must be bent to the shape of the mattress foundation corner, cover 30 is preferably constructed of a sufficiently flexible and/or stretchable material to accommodate the bending without damage. Alternatively, cover 30 may be shaped and/or sized to accommodate any expected bending.

Although cover 32 may be constructed of a variety of suitable materials or combinations thereof, one material that has been found particularly useful is fabric. It will be appreciated that virtually any fabric, whether natural or synthetic, would be suitable and within the scope of the invention. In addition to being relatively flexible and usually at least somewhat stretchable, fabric is also well suited for receiving virtually any type of ornamentation. For example, the fabric cover may be colored and/or patterned to match the color and pattern of the mattress foundation fabric. Additionally, or alternatively, logos, trademarks, or other indicia may readily be applied to the cover as desired.

There are many techniques for ornamenting the fabric which are well known in the art including dying, painting, inking, embroidery, etc., and all such techniques are within the scope of the invention. In the exemplary embodiment depicted in FIGS. 1–3, cover 32 includes one region of ornamentation 46 in which the indicia "Premier" is embroidered on the cover. Other regions of ornamentation may be added as desired. Through the use of embroidery, cover 32 may be ornamented with virtually any desired indicia or pattern, including complex, multi-colored designs. Furthermore, embroidery is not susceptible to damage when the fabric is flexed during installation. Finally, because the embroidery stitching passes over the surface of the fabric cover, embroidery also provides a three-dimensional appearance to the cover.

While the cover of corner guard 20 is depicted and described as being ornamented, ornamentation is not an essential element of the invention as the cover, even without ornamentation, functions to improve the appearance of the corner guard by concealing the core. Moreover, cover 32 is not limited to fabric but can be any of a variety of suitable materials or combinations of materials. It will be appreciated, therefore, that the method of ornamenting the cover may vary depending on the cover material.

Cover 32 may be attached to core 30 by any of several methods or combinations thereof, depending on the materials from which the core and cover are constructed. For example, the cover may be attached by sewing, stapling, and/or gluing the cover to the core. In the latter case, a suitable adhesive is selected based on the materials of the cover and core.

In the embodiment depicted in FIGS. 1–5, the fabric cover is sewn directly to the plastic core. The stitching 48 which passes through the fabric and the core further enhances the appearance of the corner guard by providing a quilted look to the corner guard. If desired, the attachment of cover 32 to the core may be reinforced by sewing the cover to the core with a binding tape 50 or similar material. As shown in FIG. 5, an upper edge of the cover may be folded and wrapped over upper edge 40 of the core so that stitching 48 passes through two layers of the cover. In this configuration, and depending on the strength of the fabric cover, the use of binding tape may be unnecessary. In contrast, a lower edge is folded along the bottom of tabs 44 but does not wrap around the end of the tabs. In this configuration, the stitching only passes through a single layer of the fabric cover so that binding tape may be desired to reinforce the fabric. While the lower edge of fabric cover 32 is depicted as sewn to tabs 44, it will be appreciated that the lower edge may be attached to the core in addition to, or instead of, the tabs.

In the embodiment depicted in FIGS. 4 and 5, the cover is attached to the core so as to cover all of front surface 36 and only a portion of back surface 38. In an alternative embodiment, the cover is formed as a sleeve or pocket that is sized to fit around core 30 with only an opening from which tabs 44 may extend. Thus, as shown by the dashed line in FIG. 5, cover 32 extends over substantially all back surface 38 as well as front surface 36. Once the cover is formed, the core may be slipped into the cover and then attached as described above. Alternatively, the pocket may be sized to provide a sufficiently tight fit so that once the core is inserted, the pocket remains in place around the core without further attachment. In either case, the pocket provides a "finished" look to the back as well as the front of the corner guard.

As mentioned briefly above, one embodiment of corner guard 20 includes a compressible lining 34 positioned between the cover and the core. Compressible lining 34 may include a layer of foam, sponge, or similar material, and functions to enhance the quilted appearance of the corner guard. In addition, foam layer 34 provides additional padding to absorb impacts. In the embodiment shown in FIGS. 3 and 5, the lining extends across substantially the entire front surface of the core. However, it will be appreciated that the lining may alternatively extend over only a portion of the front surface, or may extend over portions of both the front and back surfaces of the core. In any event, lining 34 may be attached to the cover and/or the core by any of a variety of means such as sewing, stapling, or gluing. Alternatively, the lining may be held in place by the attachment of the cover to the core.

Another way of understanding the present invention is illustrated in FIG. 5 in which it can be seen that corner guard 20 is characterized by a multi-layer cross-section, wherein each layer performs different functions. Specifically, a cross-section of at least a portion of corner guard 20 is characterized by an impact-resistant first layer 30 adapted to protect a mattress foundation corner, a relatively flexible second layer 32 coupled to the first layer and configured to conceal at least a portion of the first layer, and a relatively compressible third layer 34 intermediate the first layer and second layer. Alternatively, the third layer may be omitted as desired.

While the invention has been disclosed in its preferred form, the specific embodiments thereof as disclosed and illustrated herein are not to be considered in a limiting sense as numerous variations are possible. Applicants regard the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicants' invention.

We claim:

1. A bedding assembly, comprising:

a fabric covered mattress foundation including a bottom surface, an upper support surface, and a plurality of side surfaces extending between the bottom surface and the upper support surface, where at least two of the side surfaces intersect to form an exterior corner;

a frame supporting the mattress foundation; and a corner guard positioned between the mattress foundation and the frame, and attached to the mattress foundation to cover at least a portion of the corner adjacent the bottom surface;

wherein the corner guard includes:

an impact-resistant core sized to extend around the corner from one of the two side surfaces to the other, and a cover overlying at least a portion of the core opposite the mattress foundation.

2. The bedding assembly of claim 1, wherein the cover is constructed of fabric.

3. The bedding assembly of claim 2, further comprising a foam lining disposed between the cover and the core.

4. The bedding assembly of claim 2, wherein the cover is attached to the core by at least one of either sewing, stapling, or gluing the cover to the core.

5. The bedding assembly of claim 1, wherein the fabric of the cover substantially matches the fabric of the mattress foundation.

6. The bedding assembly of claim 1, wherein the fabric of the mattress foundation has a design, and wherein the fabric of the cover includes the same design as the fabric of the mattress foundation.

7. The bedding assembly of claim 1, wherein the corner guard includes at least one tab attached to the core.

8. The bedding assembly of claim 7, wherein the tab is attached to the mattress foundation.

9. The bedding assembly of claim 7, wherein the tab extends generally perpendicularly from the core.

10. The bedding assembly of claim 8, wherein the tab is attached to the bottom surface of the mattress foundation.

11. The bedding assembly of claim 8, wherein the core is constructed of plastic.

12. The bedding assembly of claim 8, wherein the core is constructed of metal.

* * * * *